US009487988B2

(12) United States Patent
Bacchetti

(10) Patent No.: US 9,487,988 B2
(45) Date of Patent: Nov. 8, 2016

(54) HINGE DEVICE FOR DOORS, SHUTTERS OR THE LIKE

(71) Applicant: IN & TEC S.R.L., Brescia (IT)

(72) Inventor: Luciano Bacchetti, Nave (IT)

(73) Assignee: IN & TEC S.R.L., Brescia (IT)

( * ) Notice: Subject to any disclaimer, the term of this patent is extended or adjusted under 35 U.S.C. 154(b) by 0 days.

(21) Appl. No.: 15/025,196

(22) PCT Filed: Oct. 6, 2014

(86) PCT No.: PCT/IB2014/065078

§ 371 (c)(1),
(2) Date: Mar. 25, 2016

(87) PCT Pub. No.: WO2015/049672

PCT Pub. Date: Apr. 9, 2015

(65) Prior Publication Data

US 2016/0237730 A1 Aug. 18, 2016

(30) Foreign Application Priority Data

Oct. 4, 2013 (IT) ..... VI2013A0245

(51) Int. Cl.
*E05F 3/18* (2006.01)
*E05F 1/12* (2006.01)
*E05F 3/20* (2006.01)

(52) U.S. Cl.
CPC ..... *E05F 3/18* (2013.01); *E05F 1/1223* (2013.01); *E05F 3/20* (2013.01); *E05Y 2201/638* (2013.01); *E05Y 2800/296* (2013.01); *Y10T 16/2771* (2015.01)

(58) Field of Classification Search
CPC ..... E05F 3/18; E05F 1/1223; E05F 3/10; E05F 3/04; E05F 3/20; E05Y 2201/638; E05Y 2800/296; Y10T 16/304; Y10T 16/2771; Y10T 16/2769; Y10T 16/61; Y10T 16/5398; Y10T 16/53988; Y10T 16/53992; E05D 7/081
USPC ..... 16/50, 54, 53, 82, 312, 316, 317
See application file for complete search history.

(56) References Cited

U.S. PATENT DOCUMENTS 1,200,538 A 10/1916 Smith et al.
1,927,778 A * 9/1933 Hirakawa ..... E05F 3/20 16/54

(Continued)

FOREIGN PATENT DOCUMENTS

WO WO0166894 A1 9/2001
WO WO2006025663 A1 3/2006

*Primary Examiner* — William Miller
(74) *Attorney, Agent, or Firm* — Themis Law

(57) ABSTRACT

A hinge device includes a first fixed tubular half-shell having a working chamber defining a longitudinal axis, a second tubular half-shell rotatable about the longitudinal axis, a pivot rotating unitary with the latter which includes a single pass-through actuating member having a helical shape, a plunger member slidable along the longitudinal axis, and a tubular bushing having a pair of guide cam slots. A pin inserted within the pass-through actuating member is provided to allow the mutual engagement of the pivot and the bushing. The first tubular half-shell includes an end portion susceptible to rotatably support the pivot, the second tubular half-shell and the bushing are coaxially coupled to each other, and the bushing and the first tubular half-shell are mutually unitarily coupled.

10 Claims, 3 Drawing Sheets

(56) References Cited

U.S. PATENT DOCUMENTS 2,456,537 A * 12/1948 Seaman ..... E05F 3/10 16/54
4,068,344 A * 1/1978 Okabe ..... E05F 3/20 16/54
4,485,522 A * 12/1984 Chen ..... E05F 3/20 16/303
4,756,051 A * 7/1988 Shy ..... E05F 3/14 16/299
5,855,040 A * 1/1999 Lin ..... E05D 5/10 16/50
6,205,619 B1 * 3/2001 Jang ..... E05D 5/10 16/352
6,658,694 B2 * 12/2003 Wang ..... E05F 1/1223 16/284
7,155,776 B2 * 1/2007 Park ..... E05F 3/20 16/312
8,898,860 B2 * 12/2014 Bacchetti ..... E05F 1/1223 16/303
9,009,916 B2 * 4/2015 Nagl ..... E05F 3/20 16/256
2015/0121653 A1 * 5/2015 Bacchetti ..... E05F 3/104 16/54
2015/0204128 A1 * 7/2015 Bacchetti ..... E05F 1/1223 16/53
2015/0233164 A1 * 8/2015 Bacchetti ..... E05F 3/20 16/54

* cited by examiner

HINGE DEVICE FOR DOORS, SHUTTERS OR THE LIKE

FIELD OF INVENTION

The present invention is generally applicable to the technical field of the closing and/or control hinges for doors, shutters or like closing elements, and particularly relates to a hinge device for rotatably moving and/or controlling during closing and/or opening a closing element, such as a door, a shutter or the like, anchored to a stationary support structure, such as a wall or a frame.

BACKGROUND OF THE INVENTION

As known, hinges generally include a movable member, usually fixed to a door, a shutter or the like, pivoted onto a fixed member, usually fixed to the support frame thereof, or to a wall and/or to the floor.

From documents U.S. Pat. No. 7,305,797, US2004/206007 and EP1997994 hinges are known wherein the action of the closing means that ensure the return of the door in the closed position is not damped. From document EP0407150 is known a door closer which includes hydraulic damping means for damping the action of the closing means.

All these known devices are more or less bulky, and consequently they have an unpleasant aesthetic appeal. Moreover, they do not allow for adjustment of the closing speed and/or of the latch action of the door, or in any case they do not allow a simple and quick adjustment.

Further, these known devices have a large number of construction parts, being both difficult to manufacture and relatively expensive, and requiring frequent maintenance.

Other hinges are known from documents GB19477, U.S. Pat. No. 1,423,784, GB401858, WO03/067011, US2009/241289, EP0255781, WO2008/50989, EP2241708, CN101705775, GB1516622, US20110041285, WO200713776, WO200636044, WO2006025663, US20040250377, U.S. Pat. No.1,200,538 and WO01/66894.

These known hinges can be improved in terms of size and/or reliability and/or performance.

SUMMARY OF THE INVENTION

An object of the present invention is to overcome at least partly the above mentioned drawbacks, by providing a hinge device having high functionality, simple construction and low cost.

Another object of the invention is to provide a hinge device of high performance.

Another object of the invention is to provide a hinge device extremely safe.

Another object of the invention is to provide a hinge device that allows to keep the integrity of the closing element to which it is coupled also in case of accidental sudden opening and/or closing.

Another object of the invention is to provide a hinge device that allows a simple and quick adjustment of the opening and/or closing angle of the closing element to which it is coupled.

Another object of the invention is to provide a hinge device of small bulkiness that allows to automatically close even very heavy doors.

Another object of the invention is to provide a hinge device which ensures the controlled movement of the door to which it is coupled, during opening and/or during closing.

Another object of the invention is to provide a hinge device which has a minimum number of constituent parts.

Another object of the invention is to provide a hinge device capable of maintaining time the exact closing position over time.

Another object of the invention is to provide a hinge device extremely easy to install.

These objects, as well as others that will appear more clearly hereinafter, are achieved by a hinge according to claim 1.

Advantageous embodiments of the invention are defined in accordance with the dependent claims.

BRIEF DESCRIPTION OF THE DRAWINGS

Further features and advantages of the invention will appear more evident upon reading the detailed description of a preferred, non-exclusive embodiment of a hinge device 1, which is described as non-limiting examples with the help of the annexed drawings, in which.

DETAILED DESCRIPTION OF A PREFERRED EMBODIMENT

With reference to the above figures, the hinge device 1 is particularly useful for rotatably moving and/or controlling a closing element, such as a door, a shutter, a gate or the like, which can be anchored to a stationary support structure, such as a wall and/or a door or window frame and/or a support pillar and/or the floor.

Both the closing element and the stationary support structure, which are not part of the hinge device 1, are not shown as per se known.

Figure 1:
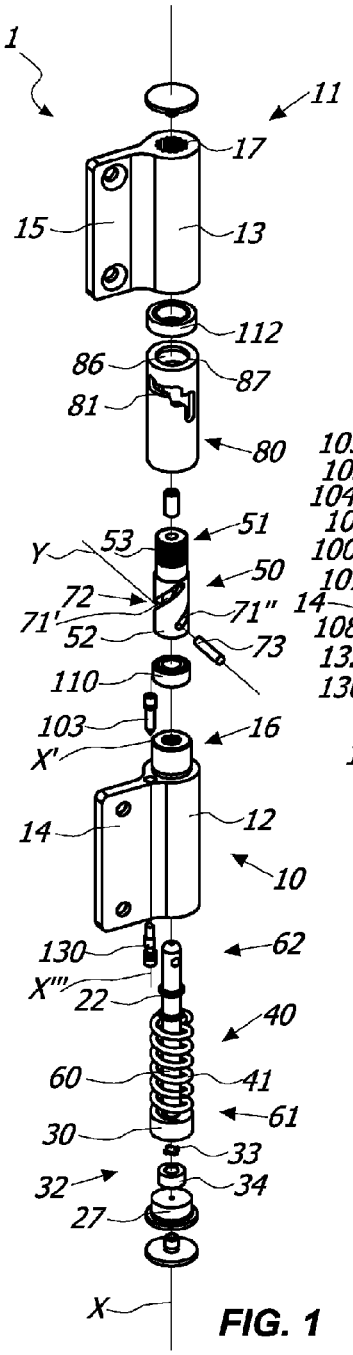
FIG. 1 is an exploded view of an embodiment of the hinge device 1.
Figure 2B:
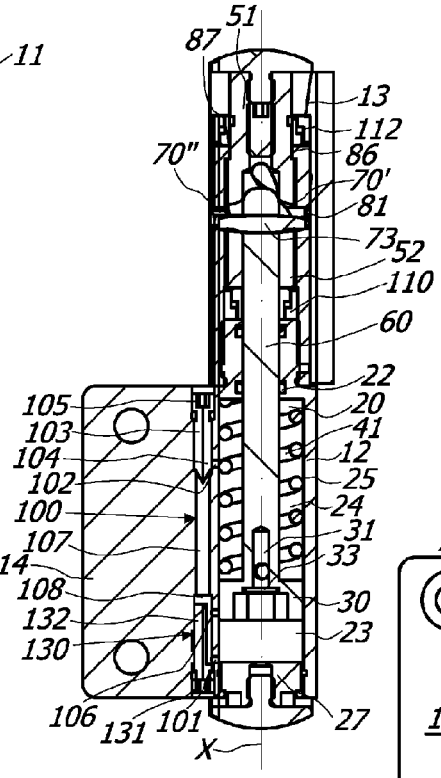
FIGS. 2*a* and 2*b* are axially sectioned views of the embodiment of the hinge device 1 of FIG. 1, wherein the second tubular half-shell 13 is respectively in the closed and open position.

Depending on the configuration, the hinge device 1 according to the invention allows only the automatic closing of the closing element to which it is coupled, only the control during opening and/or closing thereof, or both actions, as shown in FIGS. 1 to 2*b*.

Besides the configuration of the cam slots 81 of the bushing 80, the hinge device 1 can be at least partially made in accordance with the teachings of the international patent applications PCT/IB2012/051707, PCT/IB2013/059120 and/or PCT/IB2013/059121, in the name of the same Applicant.

In general, the hinge device 1 may include a fixed element 10 anchored to the stationary support structure and a movable element 11 which may be anchored to the closing element.

In a preferred, not exclusive embodiment, the fixed element 10 may be positioned below the movable element 11.

Figure 2A:
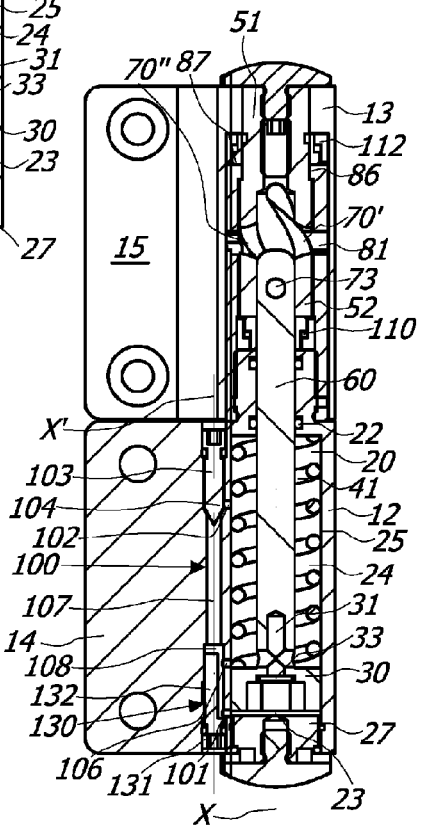

In a preferred, not exclusive embodiment, the fixed and movable elements 10, 11 may include a respective first and second tubular half-shell 12, 13 mutually coupled each other to rotate about a longitudinal axis X between an open position, shown for example in FIGS. 3*a* to 5*c*, and a closed position, shown for example in FIGS. 2*a* and 2*b*.

Suitably, the fixed and movable elements 10, 11 may include a respective first and second connecting plates 14, 15 connected respectively to the first and second tubular half-shell 12, 13 for anchoring to the stationary support structure and to the closing element.

Preferably, the hinge device 1 can be configured as an "Anuba"-type hinge.

Advantageously, with the exception of connecting plates 14, 15, all other components of the hinge device 1 may be included within the first and second tubular half-shells 12, 13.

In particular, the first tubular half-shell 12 may be fixed and include a working chamber 20 defining the axis X and a plunger member 30 sliding therein. Appropriately, the working chamber 20 can be closed at an end by a closing cap 27 inserted into the tubular half-shell 12.

As better explained later, the first fixed tubular half-shell 12 may further include a working fluid, usually oil, acting on the piston 30 to hydraulically counteract the action thereof and/or elastic counteracting means 40, for example a helical compression spring 41, acting on the same plunger member 30.

Suitably, externally to the working chamber 20 and coaxially therewith a pivot 50 may be provided, which may advantageously act as an actuator, which may include an end portion 51 and a tubular body 52. Advantageously, the pivot 50 may be supported by the end portion 16 of the first fixed tubular half-shell 12.

The end portion 51 of the pivot 50 will allow the coaxial coupling between the same and the second movable tubular half-shell 13, so that the latter and the pivot 50 unitary rotate between the open and the closed positions of the second movable tubular half-shell 13.

To this end, in a preferred, not exclusive embodiment, the end portion 51 of the pivot 50 may include an outer surface 53 having a predetermined shape which is coupled, preferably in a removable manner, with a countershaped surface 17 of the second movable tubular half-shell 13.

In a preferred, not exclusive embodiment, the shaped surface 53 may include a plurality of axial projections, susceptible to engage corresponding recesses of the countershaped surface 17.

Suitably, the plunger member 30 and the pivot 50 may be operatively connected to each other through the elongated cylindrical element 60, so that the rotation of the latter about the axis X corresponds to the sliding of the former along the same axis X and vice-versa.

To this end, the elongate element 60 may include a first cylindrical end portion 61 inserted within the working chamber 20 and mutually connected with the plunger member 30 and a second end portion 62 external to the working chamber 20 and sliding within the tubular body 52 of the pivot 50.

The connection between the elongate cylindrical element 60 and the plunger member 30 may be susceptible to make unitary these elements, so that they may define a slider movable along the axis X.

Advantageously, the tubular portion 52 of the pivot 50 may have an internal diameter substantially coincident with the diameter of the elongated cylindrical element 60.

The elongated cylindrical element 60 may therefore be slidable along the axis X unitary with the plunger member 30. In other words, the elongated cylindrical element 60 and the pivot 50 may be coupled together in a telescopic manner.

Therefore, the plunger member 30 may slide along the axis X between an end-stroke position proximal to the pivot 50, corresponding to one of the open and closed position of the second movable tubular half-shell 13, and an end-stroke position distal from the pivot 50, corresponding to the other of the open and closed position of the second movable tubular half-shell 13.

To allow the mutual movement between the plunger member 30 and the pivot 50, the tubular body 52 of the latter may include at least one pair of grooves 70', 70" equal to each other angularly spaced by 180°, each comprising at least one helical portion 71', 71" wound around the axis X. The grooves 70', 70" may be communicating with each other to define a single passing-through actuating member 72.

Figure 6:
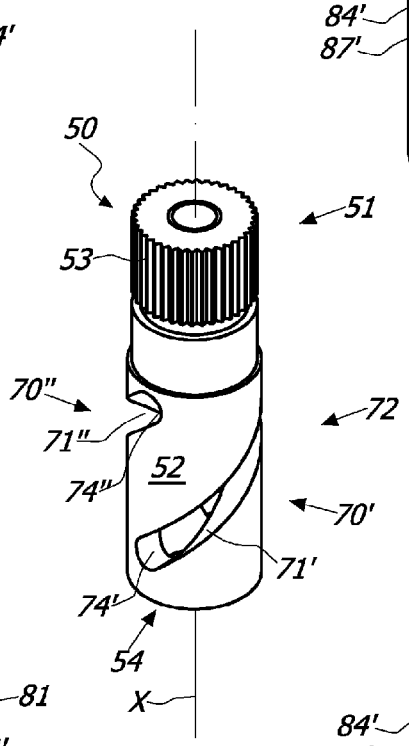
FIG. 6 is an axonometric enlarged view of the embodiment of the pivot 50 shown in the embodiment of the hinge device 1 of FIG. 1.

In FIG. 6 an embodiment of passing-through actuating member 72 is shown. Suitably, the at least one helical portion 71', 71" may have any inclination, and may be right-handed, respectively left-handed. Preferably, the at least one helical portion 71', 71" may be wound for at least 90° around the axis X, and even more preferably for at least 180°.

Advantageously, the at least one helical portion 71', 71" may have a helical pitch of 20 mm to 100 mm, and preferably of 30 mm to 80 mm.

In a preferred, not exclusive embodiment, each of the grooves 70', 70" may be formed by a single helical portion 71', 71" which may have constant inclination or helical pitch.

Conveniently, the actuating member 72 may be closed at both ends so as to define a closed path having two end blocking points 74', 74" for the pin 73 sliding therethrough, the closed path being defined by the grooves 71', 71".

Irrespective of its position or configuration, the actuating member 72 rotating around the axis X allows the mutual movement of the pivot 50 and the plunger member 30.

To guide this rotation, a tubular guide bushing 80 external to the tubular body 52 of the pivot 50 and coaxial thereto may be provided. The guide bushing 80 may include a pair of cam slots 81 angularly spaced by 180°.

To allow the mutual connection between the pivot 50, the elongated element 60 and the guide bushing 80, the second end portion 62 of the elongated element 60 may include a pin 73 inserted through the passing-through actuating member 72 and the cam slots 81 to move within them.

Therefore, the length of the pin 73 may be such as to allow this function. The pin 73 may also define a axis Y substantially perpendicular to the axis X.

As a consequence, upon rotation of the passing-through actuating member 72 the pin 73 is moved by the latter and guided by the cam slots 81.

As already described above, the end portion 16 of the first tubular half-shell 12 may be capable of supporting the pivot 50. The bushing 80, coaxially coupled with the latter, may in turn be unitary coupled with the first tubular half-shell 12, preferably at the same end portion 16, so as to allow the coupling of the first and second tubular half-shell 12, 13.

Advantageously, the tubular portion 52 of the pivot 50 may have an external diameter less than or possibly substantially coincident with the internal diameter of the bushing 80.

As mentioned above, the bushing 80 and the second tubular half-shell 13 may be further coupled each other in a removable manner, for example by sliding the latter onto the former along the axis X and subsequent mutual engagement between the outer shaped surface 53 and the countershaped surface 17.

This greatly simplify the maintenance operations of the closing element, as the same may be removed from the operative position by simple lifting it, without disassembling the hinge device 1.

In this case, the second tubular half-shell will remain in operative position on the bushing 80 simply thanks to the gravity force.

Suitably, the cam slots 81 of the bushing 80 may be closed at both ends so as to define a closed path having two end blocking points 87', 87" for the pin 73 sliding therethrough.

FIGS. 3*a* to 4*b* show some embodiments of the bushing 80, in which the cam slots 81 may include a first portion 84' and a second portion 84".

Figure 3A:
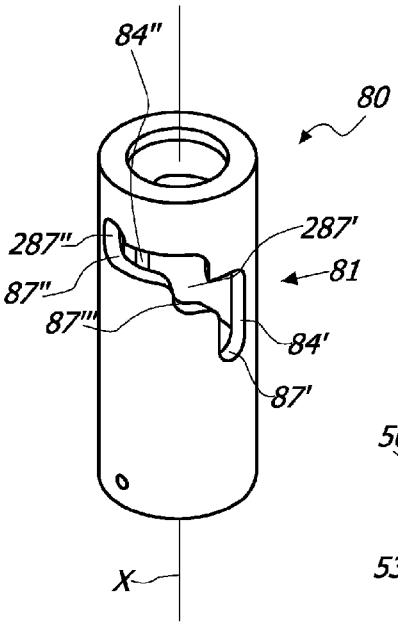
FIGS. 3*a* and 3*b* are axonometric enlarged views of the embodiment of the bushing 80 shown in the embodiment of the hinge device 1 of FIG. 1.
Figure 3B:
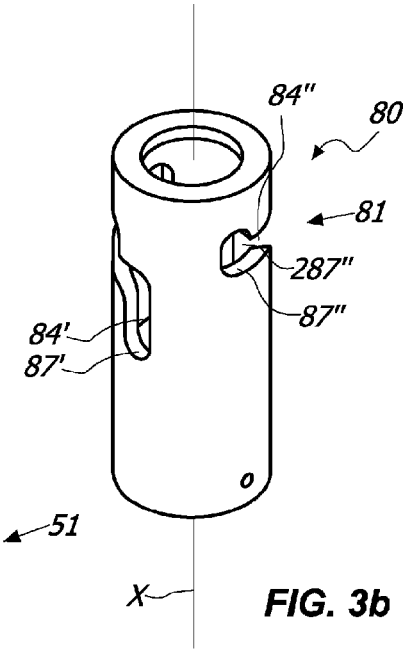
Figure 4A:
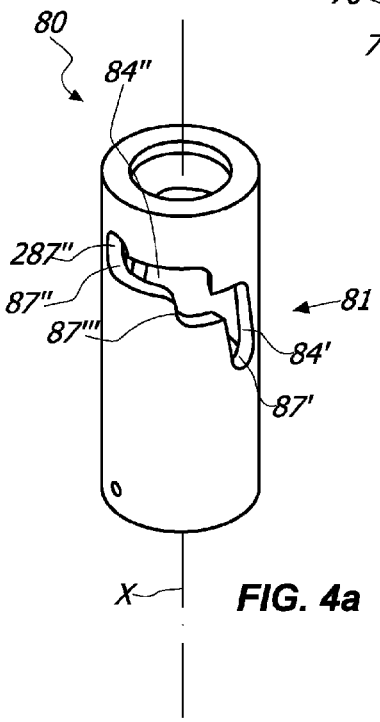
FIGS. 4*a* and 4*b* are axonometric enlarged views of a further embodiment of the bushing 80.
Figure 4B:
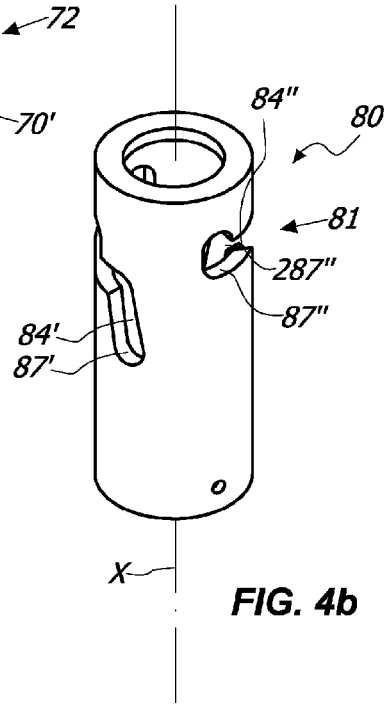

The first portion 84' may extend substantially parallel to the axis X, as shown in FIGS. 3*a* and 3*b*, or may be slightly inclined with respect to the same axis X with opposite inclination with respect to that of the grooves 70', 70" of the pivot 50, as shown in FIGS. 4*a* and 4*b*.

On the other hand, the second portion 84" may extend substantially perpendicularly to the axis X.

Suitably, the first and the second portion 84', 84" may each have a length sufficient to guide the rotation of the movable tubular half-shell 13 for 90° around the axis X.

FIGS. 5*a* to 5*e* show a hinge device 1 that includes the bushing 80 in accordance with FIGS. 3*a* and 3*b*.

Figures 5A, 5B, 5C, 5D, 5E:
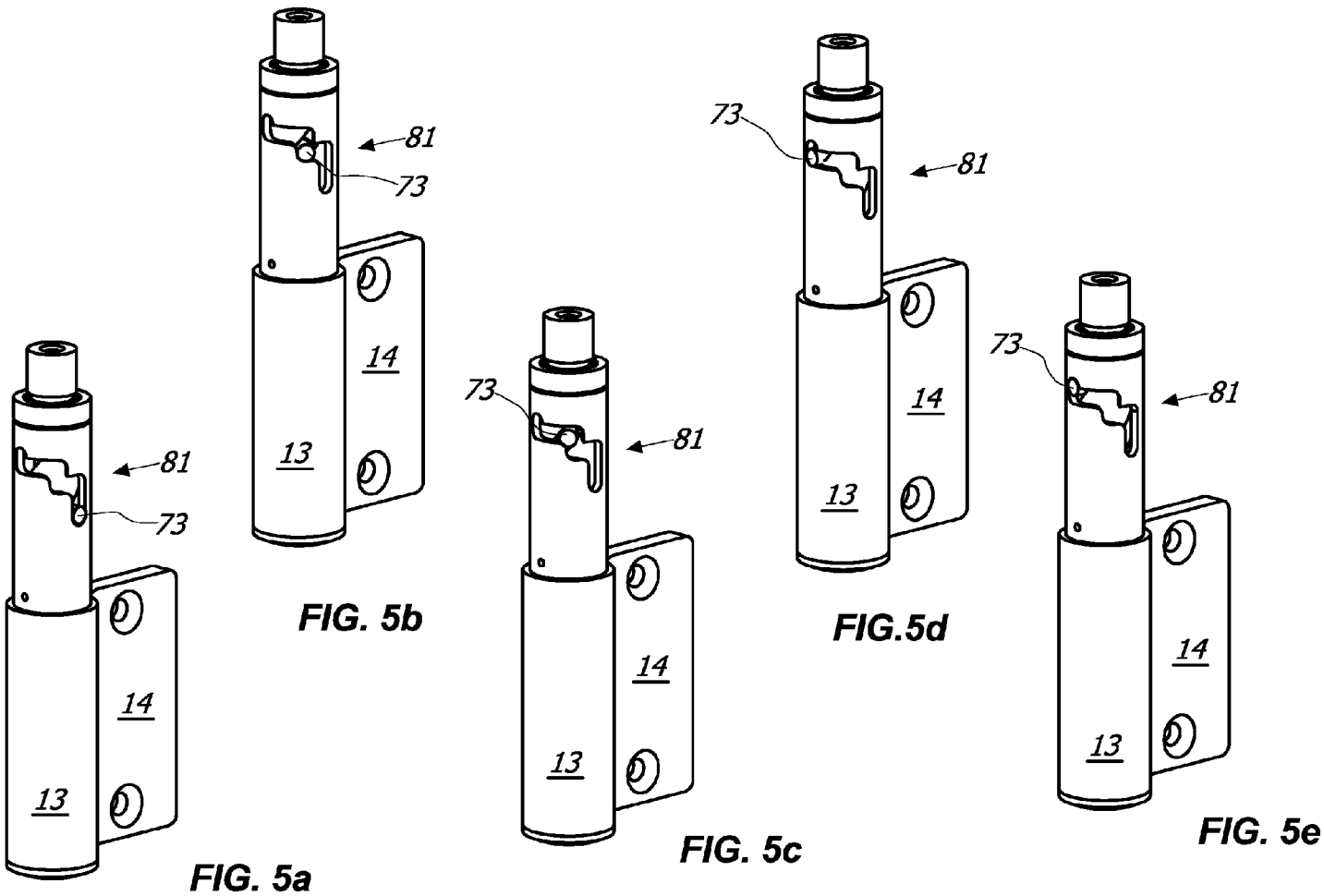
FIGS. 5*a* to 5*e* are axonometric views of the embodiment of the hinge device 1 of FIG. 1, wherein the pin 73 is in several positions along the cam slots 81.

FIG. 5*a* shows the position completely closed of the closing element. The pin 73 is in correspondence of the first end blocking point 87'.

FIG. 5*b* shows the position of the closing element at 90° with respect to the closed door position. The pin 73 is in correspondence of an intermediate blocking point 87'".

In correspondence of the latter a first shock-absorbing portion 287' may be provided that extends substantially parallel to the axis X in a direction concordant to the sliding direction of the pin 73 within the first portion 84' to allow a further minimum compression of the spring 41, for example of 1-2 mm, which may correspond to a further slight rotation of the movable tubular half-shell 13. In the embodiment shown, the first shock-absorbing portion 287' guides the pin 73 so as to rotate the closing element from 90°, which position is shown in FIGS. 5*b*, to 120° with respect to the closed door position, as shown in FIG. 5*c*.

FIG. 5*b* shows the position of closing element at 180° with respect to the closed door position. The pin 73 is in correspondence of the second blocking point 87".

In correspondence of the latter a second shock-absorbing portion 287" may be provided to guide the pin 73 so as to rotate the closing element from 180°, which position is shown in FIGS. 5*d*, to 190° with respect to the door closed position, as shown in FIG. 5*e*.

Advantageously, the blocking points 87', 87", 87'" may include zones of the cam slots 81 against which the pin 73 abuts during its sliding through the same cam slots 81 to block the closing element during opening and/or closing.

The shock-absorbing portions 287', 287" allow to absorb the shock imparted to the closing element by the abutment of the pin 73 against the blocking points 87', 87".

In fact, this abutment is rigidly transferred to the closing element, with the consequent unhinging danger thereof. Therefore, the shock-absorbing portions 287', 287" allow a further compression of the spring 41 which absorb the shock of the abutment of the pin 73 against the blocking points 87", 87'", thus avoiding the above danger.

This configuration is particularly advantageous in case of aluminium doors, so as to avoid the reciprocal torsion of the closing element and the stationary support structure, for example a frame.

Suitably, the shock-absorbing portions 287', 287" may have a length sufficient to allow a further minimum rotation of the movable element 11 of 5° to 15° around the axis X.

A further advantage of the above configuration is that even if the closing element rotates beyond the open position determined by the blocking points 87", 87'", the spring 41 returns the same closing element in the predetermined open position. Therefore, the action of the shock-absorbing portions 287', 287" does not affect the predetermined open position of the closing element, which therefore is maintained over time even in the case of several shock-absorbing actions.

It is understood that both the blocking points that the shock-absorbing portions of the cam slots 81 may be in any number without departing from the scope of the appended claims.

Advantageously the hinge device 1 may include a working fluid, for example oil.

The working chamber 20 may include one or more sealing elements 22 to prevent the leakage thereof, for example one or more o-rings.

The plunger member 30 may separate the working chamber 20 in at least one first and at least one second variable volume compartment 23, 24 fluidly communicating each other and preferably adjacent. Suitably, if present, the elastic counteracting means 40 can be inserted in the first compartment 23.

To allow the passage of the working fluid between the first and the second compartments 23, 24, the plunger member 30 may comprise a passing-through opening 31 and valve means, which may include a non-return valve 32.

Advantageously, the non-return valve 32 may include a disc 33 inserted with minimum clearance in a suitable housing 34 to move axially along the axis X.

Depending on the direction in which the non-return valve 32 is mounted, it opens upon the opening or closing of the closing element, so as to allow the passage of the working fluid between the first compartment 23 and second compartment 24 during one of the opening or closing of the closing element and to prevent backflow thereof during the other of the opening or the closing of the same closing element.

For the controlled backflow of the working fluid between the first compartment 23 and the second compartment 24 during the other of the opening or closing of the closing element, a suitable hydraulic circuit 100 may be provided.

Suitably, the plunger member 30 may include, or respectively may consist of, a cylindrical body tightly inserted in the working chamber 20 and facing the inner side wall 25 thereof. The hydraulic circuit 100 may at least partially lye within the first tubular half-shell 12, and may preferably include a channel 107 external to the working chamber 20 which defines an axis X' substantially parallel to the axis X.

Advantageously, the hydraulic circuit 100 may include at least one first opening 101 in the first compartment 23 and at least one further opening 102 in the second compartment 24. Depending on the direction in which is mounted the valve 32, the openings 101, 102 may act respectively as inlet and outlet of the circuit 100 or as outlet and inlet thereof.

The first tubular half-shell 12 may have at least one first adjusting screw 103 having a first end 104 which interacts with the opening 102 of the hydraulic circuit 100 and a second end 105 which can be operated from outside by a user to adjust the flow section of the working fluid through the same opening 102.

In the embodiment shown in FIGS. 1 to 2*b* the valve 32 opens upon opening of the closing element and closes upon closing thereof, thus forcing the working fluid to flow back through the hydraulic circuit 100. In these conditions, the opening 101 acts as inlet of the hydraulic circuit 100 while the opening 102 acts as outlet thereof.

Suitably, the outlet 102 may be fluidly decoupled from the plunger member 30 during the whole stroke thereof. The screw 103 may have the first end 104 which interacts with the opening 102 to adjust the closing speed of the closing element.

In this preferred but not exclusive embodiment, the hydraulic circuit 100 may include a further opening 106 in the second compartment 24, which in the above mentioned example may act as a second outlet in the second compartment 24 for the circuit 100.

Therefore, the plunger member 30 may be in a spatial relationship with the openings 102, 106 such as to remain fluidly decoupled from the opening 102 for the entire stroke of the plunger member 30, as mentioned above, and such as to remain fluidically coupled with the opening 106 for a first part of the stroke thereof and to remain fluidly decoupled from the same opening 106 for a second part of the stroke of the plunger member 30.

In this way, in the above embodiment the closing element latches towards the closed position when the second tubular half-shell 13 is in close to the first tubular half-shell 12, or in any event when the closing element is in the proximity of the closed position.

In the case of valve 32 mounted on the contrary, i.e. that opens upon the closing of the closing element and closes upon the opening thereof, the circuit 100 configured as described above allows to have two resistances during opening, a first resistance for a first angular portion of the opening of the closing element and a second resistance for a second angular portion of the opening thereof.

In this case, upon opening of the closing element the working fluid flows from the second compartment 24 to the first compartment 23 through the channel 107, by entering through the openings 102, 106 and exiting through the opening 101. Upon the time of closing of the closing element the working fluid flows from the first compartment 23 to second compartment 24 through the valve 32. The first resistance during opening is obtained when the plunger member 30 is fluidly coupled with the opening 106 during the first part of the stroke thereof, while the second resistance during opening is obtained when the plunger member 30 is fluidly decoupled from the same opening 106 for the second part of the stroke thereof.

In the preferred but not exclusive embodiment shown in FIGS. 1 to 2*b*, the channel 107 may include a substantially cylindrical seat 108 in which a regulating member 130 can be inserted, the regulating member 130 comprising an operative end 131 and a rod 132 coupled thereto. The rod 132 may define a longitudinal axis coincident with the axis X' of the channel 107.

Suitably, the regulating member 130 may be made according with the teaching of the international patent application PCT/IB2013/059120 in name of the same Applicant, which is referred to for proper consultation.

The regulating member 130 easily allows to adjust the flow section of the opening 106 when, as in this case, the limited bulkiness of the hinge device 1 does not allow the use a "classical" radial screw.

Thanks to this configuration, it is possible to obtain both the adjustment of the closing and/or opening speed of the closing element (by acting on the adjustment screw 103) and the force of the latch action and/or of the resistances during opening (by acting on the regulating member 130) with minimum bulkiness and round shapes, typical of the "Anuba"-type hinges.

In order to minimize friction between the moving parts, at least one antifriction member may be provided, such as an annular bearing 110, interposed between the pivot 50 and the end portion 16 of the first tubular half-shell 12 for the supporting thereof.

In fact, in the above mentioned embodiment the pin 73 will be pulled downwards, thus urging downwards also the pivot 50 which therefore rotate about the axis X on the bearing 110. Suitably, the pivot 50 loads the stresses due to the action of the spring 41 on the latter bearing 110.

Suitably, at least one antifriction member may further be provided, for example a further annular bearing 112, interposed between the bushing 80 and the second tubular half-shell 13, in such a manner that the latter rotates around the axis X on the bearing 112.

Therefore, the bushing 80 may suitably have a central opening 86 in the proximity of the upper portion 87 for insertion of the end portion 51 of the pivot 50. More particularly, the bushing 80 and the pivot 50 may be mutually configured so that once the pivot 50 is inserted within the bushing 80 the end portion 51 of the former passes through the central opening 86 of the latter.

From the above description, it is apparent that the invention fulfils the intended objects.

The invention is susceptible to many changes and variants. All particulars may be replaced by other technically equivalent elements, and the materials may be different according to the needs, without exceeding the scope of the invention defined by the appended claims.

The invention claimed is:

1. A hinge device for a closing element, which is anchored to a stationary support structure, comprising:

a fixed element fixable to the stationary support structure;

a movable element fixable to the closing element, the movable element and the fixed element being mutually coupled to rotate around a longitudinal axis between an open position and a closed position; and at least one slider slidably movable along the longitudinal axis between a first end-stroke position, corresponding to one of the closed or open positions, and a second end-stroke position, corresponding to the other one of the closed or open positions, wherein one of the fixed element or movable element comprises at least one working chamber disposed along the longitudinal axis for slidably housing the at least one slider, the other one of the fixed element or movable element comprising a pivot disposed along the longitudinal axis, the pivot and the at least one slider being mutually coupled such that a rotation of the movable element around the longitudinal axis corresponds to the at least partial sliding of the at least one slider along the longitudinal axis and vice versa, wherein the working chamber further includes an elastic counteracting member acting on the at least one slider for returning the slider from one of the first or second end-stroke positions toward the other one of the first or second end-stroke positions, the elastic counteracting member being movable between a positions of maximum elongation and a position of minimum elongation, wherein the pivot includes a cylindrical portion having at least one pair of equal grooves angularly spaced of 180° each including at least one helical portion wound around the longitudinal axis, the grooves being communicating with each other to define a pass-through helical element, a tubular bushing being provided having a pair of cam slots angularly spaced at 180° and disposed externally to the pivot or the at least one slider, wherein the at least one slider includes at least one end comprising a pin inserted into the pass-through helical element and into the cam slots to slide theretrough, such to reciprocally engage the pivot, the at least one slider and the bushing, wherein the at least one helical portions is right-handed or left-handed, and the cam slots include at least one first portion extending parallel to the longitudinal axis or inclined in relation to the longitudinal axis with an inclination opposed to the one of the grooves of the pivot, the cam slots including at least one second portion extending perpendicularly thereto, wherein, when the pin slides along the first portion of the cam slots, the elastic counteracting member moves between the positions of maximum and minimum elongation, and wherein when the pin slides along the second portion of the cam slots the elastic counteracting member remains in the position of minimum or maximum elongation, wherein the helical pass-through element is closed at both ends so as to define a first closed path having two end blocking points for the pin sliding therethrough, the first closed path being defined by the grooves, the first and second portions of the cam slots being closed at both ends so as to define a second closed path having at least one first blocking point in correspondence of the first portion and at least one second blocking point in correspondence of the first portion for the pin sliding therethrough, and wherein the sliding of the pin through the at least one first portion of the cam slots starting from the at least one first blocking point corresponds to a movement of the elastic counteracting member from the position of maximum elongation to the position of minimum elongation, the cam slots of the bushing further including at least one shock-absorbing portion in correspondence of the at least one second blocking point of the at least one second portion of the cam slots, the at least one shock-absorbing portion extending parallel to the longitudinal axis in a direction concordant to a moving direction of the pin through the at least one first portion of the cam slots starting from the at least one first blocking point to allow a further minimum compression of the elastic counteracting member.

2. The device according to claim 1, wherein the at least one first blocking point or the at least one second blocking point includes an area of the cam slots against which the pin impacts during its sliding theretrough to block the closing element during opening or closing.

3. The device according to claim 1, wherein the at least one shock-absorbing portion has a length sufficient to allow a further minimum rotation of the movable element of 5° to 15° around the longitudinal axis, the minimum rotation of the movable element corresponding to the further minimum compression of the elastic counteracting member.

4. The device according to claim 1, wherein the elastic counteracting member is configured to be in the position of minimum elongation when the pin is in correspondence of the second portion of the cam slots, the elastic counteracting member being preloaded.

5. The device according to claim 1, wherein the first and second portions of the cam slots are mutually consecutive.

6. The device according to claim 1, wherein, when the pin slides along the first portion of the cam slots, the at least one slider slides between the first and second end-stroke positions while remaining rotatably blocked, and wherein, when the pin slides along the second portion of the cam slots, the at least one slider rotates unitarily with the pivot around the longitudinal axis while remaining in one of the first and second end-stroke positions.

7. The device according to claim 1, wherein the at least one helical portion extends for at least 180° around the longitudinal axis, the first and second portions of the cam slots having a length sufficient to drive the rotation of the movable element for at least 90° around the longitudinal axis.

8. The device according to claim 1, wherein the helical pass-through element consists of a single helical portion having constant inclination or helical pitch which extends for 180° around the longitudinal axis, the cam slots consisting of the first and second portions, each of the second portions having a length sufficient to guide the rotation of the movable element for 90° around the longitudinal axis.

9. The device according to claim 1, wherein the at least one working chamber includes a working fluid acting on the at least one slider to hydraulically counteract an action thereof, the at least one slider including a plunger member configured to separate the working chamber into at least one first and second variable volume compartments fluidly communicating with each other, the plunger member including a pass-through opening that puts the first and the second variable volume compartments into fluid communication and a valve interacting with the opening to allow passage of the working fluid between the first compartment and the second compartment during one of the opening or closing of the closing element and to prevent a backflow of the working fluid during the other one of the opening or the closing of the same closing element, a hydraulic circuit being provided for the backflow of the working fluid between the first compartment and the second compartment during the other one of the opening or the closing of the same closing element.

10. The device according to claim 9, wherein the elastic counteracting member is placed in the second compartment to act on the at least one slider for the returning thereof from one of the first or second end-stroke positions toward the other one of the first or second end-stroke positions.

* * * * *